US005949386A

United States Patent [19]

Elliott

[11] Patent Number: 5,949,386

[45] Date of Patent: Sep. 7, 1999

[54] QUICK-CONNECT ANTENNA

[75] Inventor: Michael Elliott, Poriya Illit, Israel

[73] Assignee: Galtronics Ltd., Tiberias, Israel

[21] Appl. No.: 09/087,187

[22] Filed: May 29, 1998

Related U.S. Application Data

[60] Provisional application No. 60/048,427, Jun. 3, 1997.

[51] Int. Cl.[6] ..... H01Q 1/50; H01Q 1/24

[52] U.S. Cl. ..... 343/906; 343/702; 343/715

[58] Field of Search ..... 343/906, 702, 343/715, 900; 439/916

[56] References Cited

U.S. PATENT DOCUMENTS 5,278,570 1/1994 Jaramillo et al. ..... 343/702

5,343,213 8/1994 Kottke et al. ..... 343/702

5,403,197 4/1995 Ernst et al. ..... 343/702

FOREIGN PATENT DOCUMENTS

601702 A1 6/1994 European Pat. Off. ..... H01R 13/71

*Primary Examiner*—Don Wong
*Assistant Examiner*—Hoang Nguyen
*Attorney, Agent, or Firm*—Ladas & Parry

[57] ABSTRACT

An antenna for connection to a communication device, the antenna having a base, which is inserted into a receptacle in the communication device, and including a connection mechanism, coupled to the base, which locks the antenna to the receptacle in response to a linear movement of at least a portion of the antenna.

5 Claims, 4 Drawing Sheets

10
13
21
19
14
17
24

10
25
14
17
25
17
25
17
25

19
16
20
25
24
25
14
19
11
II
II
17
21
21
13

10
12

QUICK-CONNECT ANTENNA

RELATED APPLICATIONS

This application claims the benefit of U.S. Provisional Patent Application 60/048,427, filed Jun. 3, 1997, which is assigned to the assignee of the present patent application and is incorporated herein by reference.

FIELD OF THE INVENTION

The present invention relates generally to communications antennas, and specifically to antennas for use in portable cellular communication devices.

BACKGROUND OF THE INVENTION

Cellular telephone antennas known in the art may be either integrally designed and built as a part of the telephone unit, or they may be modular and interchangeable. Modular antennas are advantageous in that they allow a variety of standard antenna types, with different features and specifications, to be attached to various types of telephones.

Modular antennas known in the art are generally fixed to the telephone by means of a threaded stud at the base of the antenna, which mates with a corresponding receptacle in the telephone case. Mating the threaded antenna assembly with the case is difficult to perform using automated assembly, however, and therefore adds to the cost of the antenna.

SUMMARY OF THE INVENTION

It is an object of the present invention to provide an improved mechanism and method for connecting an antenna to the case of a communications device.

In preferred embodiments of the present invention, an antenna for a cellular telephone comprises a quick-connect mechanism at its base. After the base has been inserted into a suitable receptacle in the telephone case, the mechanism locks the antenna to the case in response to a linear movement of the antenna or of a portion of the antenna. Preferably, no rotational movement is required in assembling and locking the antenna to the case.

In some preferred embodiments of the present invention, the quick-connect mechanism comprises an expanding element, which expands radially outward in response to the linear movement, after insertion of the base of the antenna into the case, thereby locking the base into the case.

Antennas in accordance with the principles of the present invention are better suited to automated assembly than are conventional screw-in antennas. Furthermore, because antennas in accordance with the present invention need not be rotated for attachment to the telephone case, they can conveniently and accurately be fixed to the case in a predetermined rotational orientation. This feature of the present invention is particularly important when the antenna has a directionally-enhanced aperture, i.e., a preferred transmission direction.

There is therefore provided, in accordance with a preferred embodiment of the present invention, an antenna for connection to a communication device, the antenna having a base, which is inserted into a receptacle in the communication device, and including a connection mechanism, coupled to the base, which locks the antenna to the receptacle in response to a linear movement of at least a portion of the antenna.

Preferably, the mechanism locks the antenna substantially without rotational movement of the mechanism.

Preferably, the mechanism includes a head-type bushing, having a head at a first end thereof and a narrowed lip at the second end, which slideably fits over the antenna and is inserted into the receptacle.

Preferably, the bushing includes a plurality of fingers, and the antenna has a corresponding plurality of slots which slideably receive the plurality of fingers.

Preferably, the mechanism includes an expandable washer, which fits over the narrowed lip of the bushing and expands responsive to the linear movement to grip the receptacle.

Preferably, the washer in its non-expanded state has an internal diameter substantially equal to the external diameter of the narrowed lip of the bushing, and an external diameter substantially equal to the diameter of the body of the bushing.

Alternatively, the base includes a groove, which constrains longitudinal movement of the washer relative to the base.

Alternatively, the base includes an index, which keys the antenna to a preferred radial orientation in the receptacle.

There is further provided, in accordance with a preferred embodiment of the present invention, a method for connecting an antenna to a communication device, including:

providing an antenna having a base and including a connection mechanism at the base of the antenna;

inserting the base into a receptacle on the communication device; and actuating the connection mechanism by a linear movement of at least a portion of the antenna, so as to lock the base in the receptacle.

Preferably, actuating the connection mechanism includes moving at least a portion of the antenna along a longitudinal axis thereof, substantially without rotating the antenna.

Alternatively, providing the connection mechanism includes fitting a head-type bushing to the base.

Preferably, providing the connection mechanism includes fitting an expandable washer over the bushing.

Preferably, actuating the connection mechanism includes radially expanding the washer responsive to the linear movement.

Alternatively, the method includes keying the antenna to a preferred radial direction in the receptacle.

The present invention will be more fully understood from the following detailed description of the preferred embodiments thereof, taken together with the drawings in which:

DETAILED DESCRIPTION OF A PREFERRED EMBODIMENT

Figures 1A, 1B, 2:
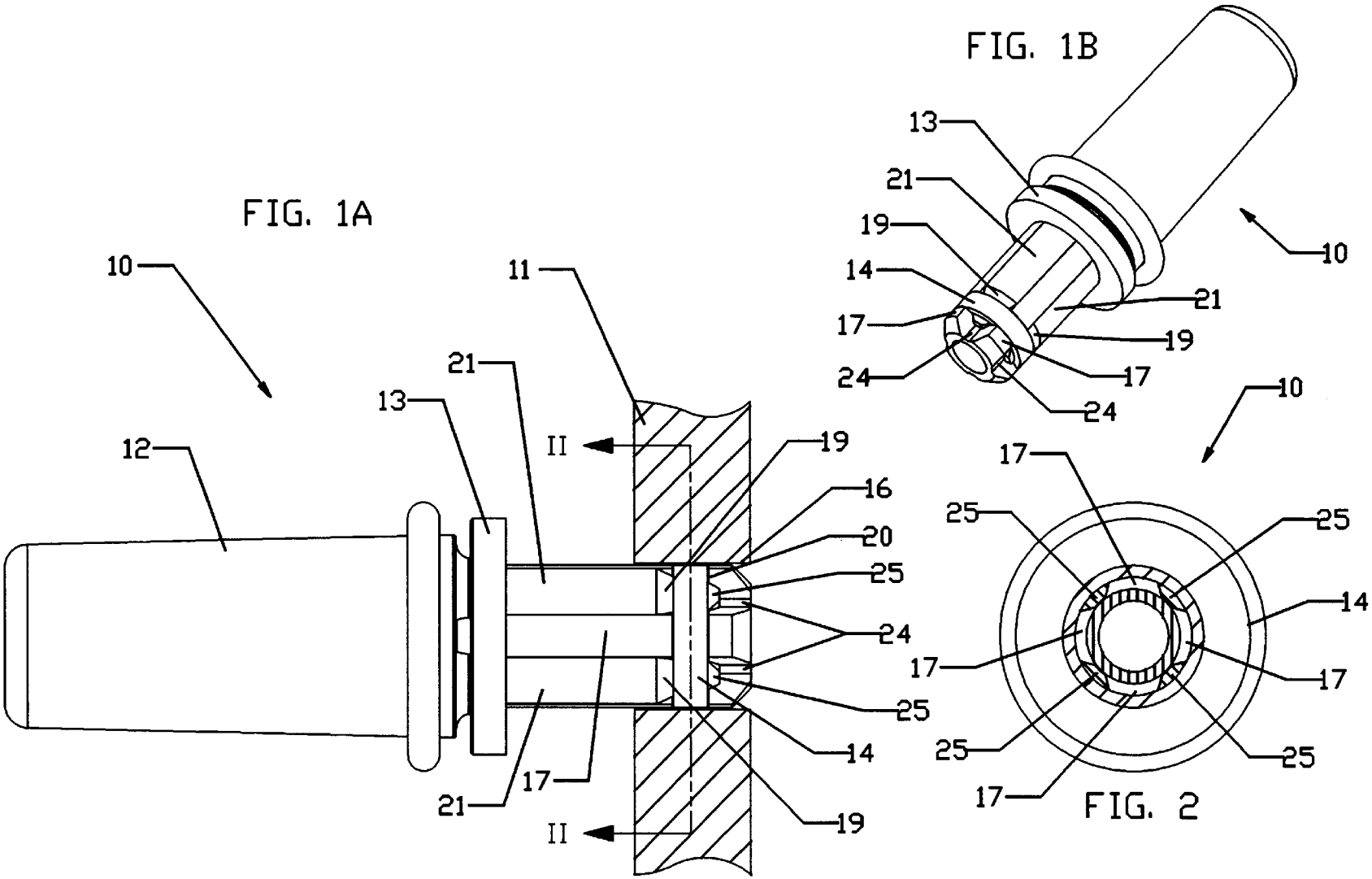
FIG. 1A is a schematic illustration showing the base of an antenna with a quick-connect mechanism during assembly thereof to a cellular telephone case in a first, open position, in accordance with a preferred embodiment of the present invention.
FIG. 1B is a schematic perspective view of the base of the antenna as shown in FIG. 1A.
FIG. 2 is a schematic cross-sectional view of the quick-connect mechanism along direction II—II of FIG. 1A.

FIGS. 1A and 1B show a quick-connect mechanism 10 in a first, open, position at the base of an antenna 12, which has been inserted into a suitable opening 16 in a cellular telephone case 11, in accordance with a preferred embodiment of the present invention. FIG. 1B is a perspective view of quick-connect mechanism 10.

Mechanism 10 comprises a plurality of longitudinal ridges 17, on the exterior of antenna 12 near the base, for example four ridges, as shown in FIG. 1B. Between consecutive ridges 17 is a plurality of slots 24. Ridges 17 are aligned parallel to the axis of the antenna, and have respective grooves 20 equidistant from the base of mechanism 10, which receive a flexible circular locking washer 14 having a substantially rectangular cross-section. Ridges 17 are preferably chamfered, to facilitate placement thereon of the locking washer. Washer 14 is positioned in grooves 20 in a manner that will allow the washer to deform radially, and twist about a circular axis defined by the washer, while retaining a fixed longitudinal position relative thereto. Washer 14 preferably comprises a resilient plastic material; alternatively washer 14 comprises a metallic spring washer. In the first, open, position of quick-connect mechanism 10 shown in FIGS. 1A, and 1B, washer 14 is in a non-deformed state.

FIG. 2 is a schematic cross-sectional view of quick-connect mechanism 10 along direction II—II of FIG. 1A, showing washer 14 in its non-deformed state.

Mechanism 10 further comprises a slideable head-type pressing bushing 13. Bushing 13 comprises a plurality of fingers 21 parallel to the bushing axis, which are received by the plurality of slots of the antenna. Thus bushing 13 can slide along the base of antenna 12. Fingers 21 respectively have a plurality of narrow lower lips 25, which fits inside expandable locking washer 14. Each lower lip 25 is preferably connected by a chamfer 19 to its respective finger. In FIGS. 1A, 1B, and 2, washer 14 has not yet been expanded and has an external diameter substantially equal to the external diameter of the body of the bushing. Washer 14 in its unexpanded state rests substantially inside grooves 20, so that mechanism 10 can easily be inserted into opening 16 and removed therefrom if necessary.

Figures 3A, 3B, 4:
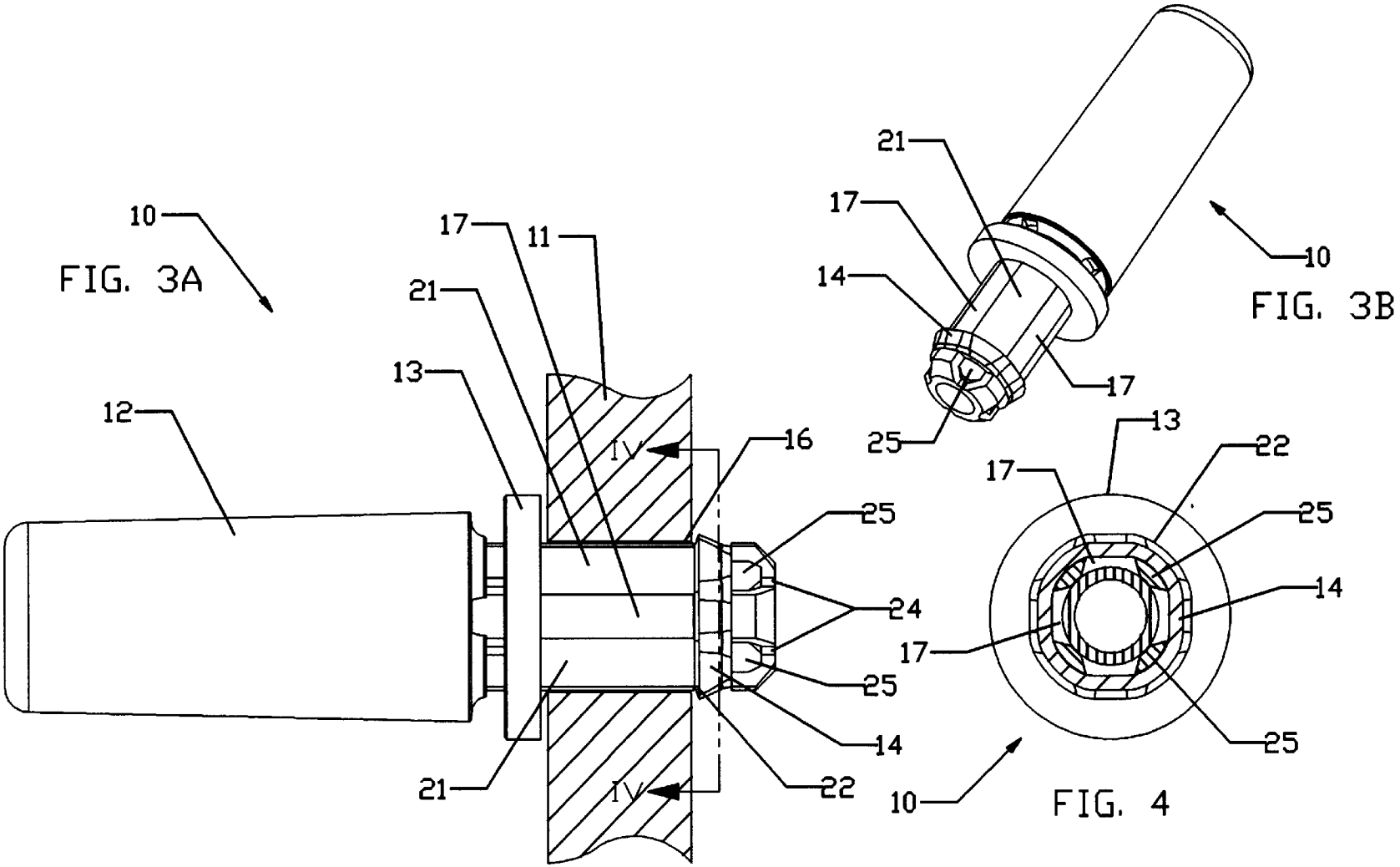
FIG. 3A is a schematic illustration showing the antenna base of FIG. 1A in a second, closed position.
FIG. 3B is a schematic perspective view of the base of the antenna as shown in FIG. 3A.
FIG. 4 is a schematic cross-sectional view of the quick-connect mechanism along direction IV–IV of FIG. 3A.

FIGS. 3A and 3B show mechanism 10 in a second, closed, position, as seen from the same respective viewpoints as FIGS. 1A and 1B. After antenna 12 has been suitably positioned in opening 16, mechanism 10 is actuated by pressing bushing 13 downward, forcing chamfers 19 through washer 14 and deforming the washer. Chamfers 19 consequently force an upper part 22 of washer 14 radially outward, in grooves 20, so as to lock antenna 12 in place against the lower part of case 11.

FIG. 4 is a schematic cross-sectional view of quick-connect mechanism 10 along direction IV—IV of FIG. 3A, showing washer 14 in its deformed state.

No rotational movement of the antenna is required, except to orient the antenna in a desired direction, if needed. It will be appreciated that if it is desired to orient the antenna in a predetermined direction, an index may be applied to one of fingers 21 or to one of ridges 17, and a corresponding slot provided in case 11.

If necessary, antenna 12 may be removed from case 11 by prying or pulling bushing 13 upward, whereupon washer 14 will contract inward, returning the antenna to the open position of FIG. 1A.

Figure 5B:
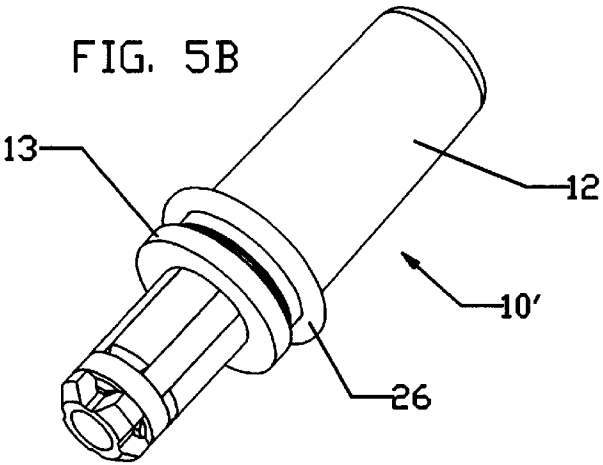
FIG. 5B is a schematic perspective view of the base of the antenna as shown in FIG. 5A.
Figure 5A:
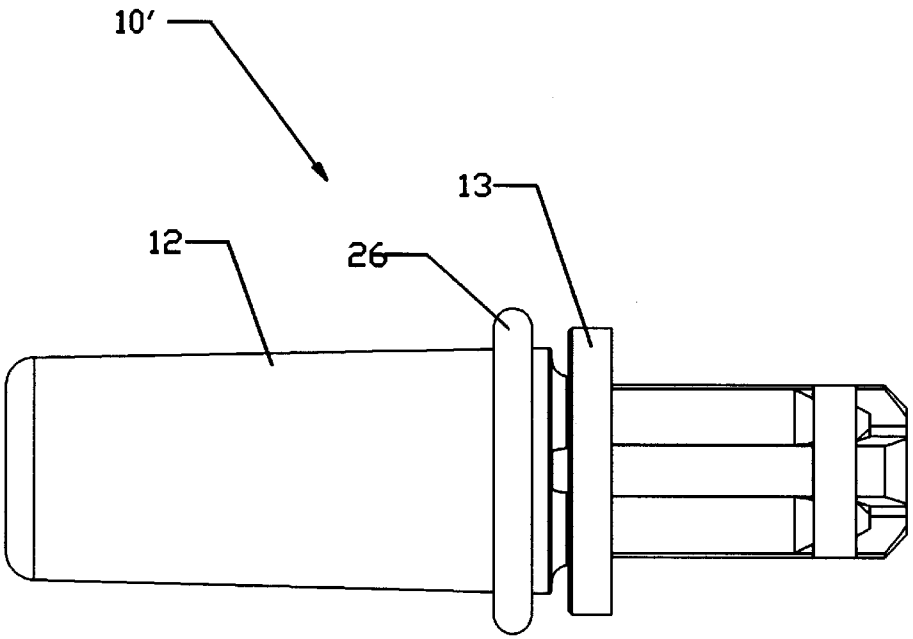
FIG. 5A is a schematic illustration showing the base of an antenna with a quick-connect mechanism during assembly thereof to a cellular telephone case in a first, open position, in accordance with an alternative preferred embodiment of the present invention.
Figure 6B:
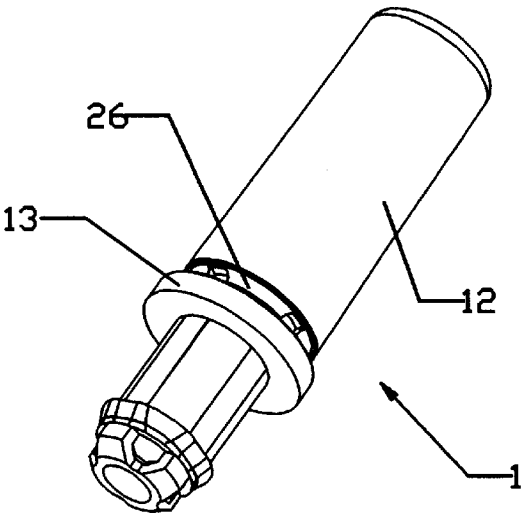
FIG. 6B is a schematic perspective view of the base of the antenna as shown in FIG. 6A.
Figure 6A:
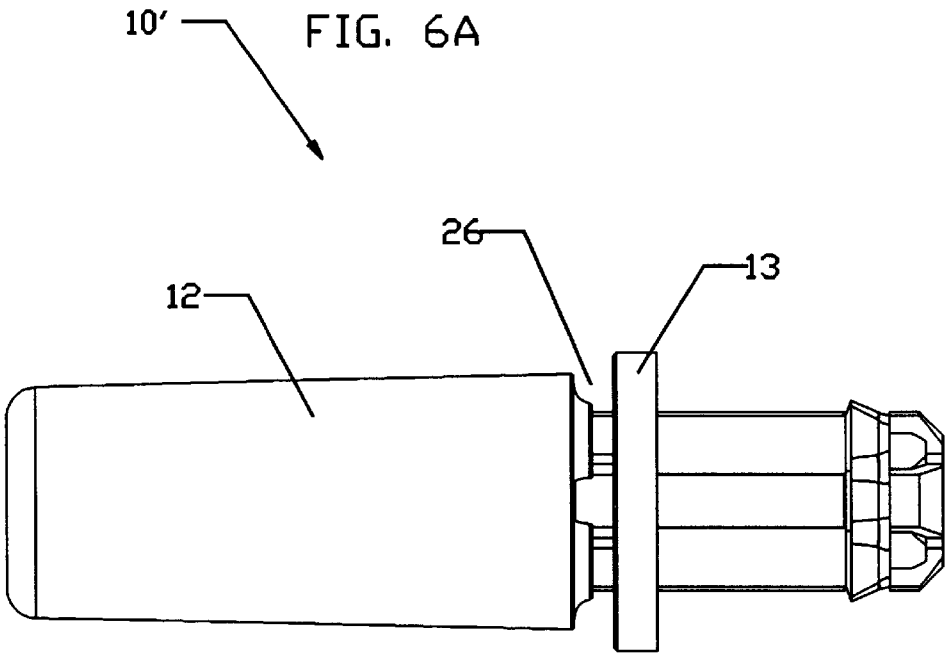
FIG. 6A is a schematic illustration showing the antenna base of FIG. 5A in a second, closed position.

Reference is now made to FIGS. 5A and 5B, which show a quick-connect mechanism 10' in a first, open, position, and to FIGS. 6A and 6B, which show quick-connect mechanism 10' in a second, closed, position, in accordance with an alternative preferred embodiment of the present invention. Apart from the differences described below, the operation of mechanism 10' is substantially the same as that of mechanism 10 (FIGS. 1A, 1B, 3A, and 3B), whereby elements indicated by the same reference numerals in both mechanism 10' and mechanism 10 are generally identical in construction and in operation. Mechanism 10' comprises a flexible washer 26 fit over antenna 12. FIGS. 5A and 5B show washer 26 when mechanism 10' is in its first, open, position, so that bushing 13 is able to move as described hereinabove with reference to mechanism 10, and mechanism 10' may be easily inserted into opening 16 and removed therefrom if necessary. FIGS. 6A and 6B show washer 26 when mechanism 10' is in its second, closed, position. After closing mechanism 10' in the manner described hereinabove for mechanism 10, washer 26 is slid or rolled in a downward direction, so as to lock bushing 13 in place.

The preferred embodiments shown in FIGS. 1A–6B are described herein by way of example only. It will be understood by those skilled in the art that antennas in accordance with the principles of the present invention may be produced and assembled using many other types of quick-connect mechanisms, particularly linearly-actuated mechanisms. The full scope of the invention is limited only by the claims.

What is claimed is:

1. An antenna for connection to a communication device, the antenna having a base, which is inserted into a receptacle in the communication device, and comprising a connection mechanism, coupled to the base, which locks the antenna to the receptacle in response to a linear movement of at least a portion of the antenna, wherein the mechanism comprises a head-type bushing, having a head at a first end thereof and a narrowed lip at the second end, which slideably fits over the antenna and is inserted into the receptacle, wherein the bushing comprises a plurality of fingers, and the antenna has a corresponding plurality of slots which slideably receive the plurality of fingers.

2. An antenna according to claim 1, wherein the mechanism locks the antenna substantially without rotational movement of the mechanism.

3. The antenna according to claim 1, wherein the mechanism comprises an expandable washer, which fits over the narrowed lip of the bushing and expands responsive to the linear movement to grip the receptacle.

4. The antenna according to claim 3, wherein the washer in its non-expanded state has an internal diameter substantially equal to the external diameter of the narrowed lip of the bushing, and an external diameter substantially equal to the diameter of the body of the bushing.

5. The antenna according to claim 3, wherein the base comprises a groove, which constrains longitudinal movement of the washer relative to the base.

* * * * *